US009722342B2

(12) United States Patent
Yuan et al.

(10) Patent No.: US 9,722,342 B2
(45) Date of Patent: Aug. 1, 2017

(54) ELECTRICAL CONNECTOR

(71) Applicant: Cheng Uei Precision Industry Co., Ltd., New Taipei (TW)

(72) Inventors: Sheng-Tsung Yuan, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/152,542

(22) Filed: May 11, 2016

(65) Prior Publication Data

US 2017/0149161 A1 May 25, 2017

(30) Foreign Application Priority Data

Nov. 24, 2015 (TW) ..... 104218885

(51) Int. Cl.

| | |
|---|---|
| ***H01R 13/648*** | (2006.01) |
| ***H01R 13/428*** | (2006.01) |
| ***H01R 13/6581*** | (2011.01) |
| ***H01R 24/64*** | (2011.01) |
| *H01R 107/00* | (2006.01) |

(52) U.S. Cl.

CPC ..... *H01R 13/428* (2013.01); *H01R 13/6581* (2013.01); *H01R 24/64* (2013.01); *H01R 2107/00* (2013.01)

(58) Field of Classification Search

CPC ..... H01R 13/506; H01R 13/658; H01R 13/65802; H01R 23/6873; H01R 23/7073; H01R 12/57; H01R 9/091; H01R 23/725; H01R 43/0256

USPC ..... 439/607.01, 83

See application file for complete search history.

(56) References Cited

U.S. PATENT DOCUMENTS

| | | | | |
|---|---|---|---|---|
| 7,128,611 | B2 * | 10/2006 | Tanaka | H01R 31/06 439/108 |
| 7,549,897 | B2 * | 6/2009 | Fedder | H01R 12/585 439/607.01 |
| 7,585,185 | B2 * | 9/2009 | Obikane | H01R 13/65802 439/108 |
| 7,666,031 | B2 * | 2/2010 | Kumamoto | H01R 13/65802 439/607.01 |
| 7,909,653 | B1 * | 3/2011 | Wan | H01R 13/514 439/660 |
| 8,109,795 | B2 * | 2/2012 | Lin | H01R 13/6461 439/660 |

(Continued)

*Primary Examiner* — Abdullah Riyami
*Assistant Examiner* — Vladimir Imas
(74) *Attorney, Agent, or Firm* — Cheng-Ju Chiang

(57) ABSTRACT

An electrical connector includes a main body mounted to the circuit board, a shielding plate assembly fastened to the main body, and a plurality of conductive terminals mounted to the main body and arranged in two rows. The shielding plate assembly is located between the two rows of the conductive terminals. Each of the conductive terminals has a fastening portion, a contact portion and a soldering portion. A front end of the contact portion has a contact surface. Thicknesses of two opposite sides of the front end of the contact portion are smaller than a thickness of a middle of the front end of the contact portion. The contact surfaces of the contact portions of the conductive terminals are exposed to a top surface and a bottom surface of the main body, respectively.

17 Claims, 9 Drawing Sheets

(56) References Cited

U.S. PATENT DOCUMENTS

| | | | | |
|---|---|---|---|---|
| 8,231,410 | B2 * | 7/2012 | Tung | H01R 13/506 439/607.01 |
| 8,323,057 | B2 * | 12/2012 | Ho | H01R 12/725 439/607.4 |
| 8,684,769 | B2 * | 4/2014 | Kao | H01R 13/6471 439/607.28 |
| 8,801,470 | B2 * | 8/2014 | Hsueh | H01R 4/023 439/607.01 |
| 8,827,751 | B1 * | 9/2014 | Lan | H01R 13/516 439/607.01 |
| 8,851,927 | B2 * | 10/2014 | Hsu | H01R 12/724 439/607.11 |
| 8,936,492 | B2 * | 1/2015 | Ho | H01R 12/724 439/660 |
| 9,022,800 | B2 * | 5/2015 | Yang | H01R 13/6581 439/487 |
| 9,083,130 | B2 * | 7/2015 | Casher | H01R 12/724 |
| 9,281,625 | B2 * | 3/2016 | Kao | H01R 13/6471 |
| 9,281,643 | B1 * | 3/2016 | Tseng | H01R 13/518 |
| 9,312,641 | B2 * | 4/2016 | Wang | H01R 13/6585 |
| 9,425,558 | B1 * | 8/2016 | Hsu | H01R 12/724 |
| 9,450,337 | B2 * | 9/2016 | Kao | H01R 13/6461 |
| 9,461,412 | B2 * | 10/2016 | Yu | H01R 13/6585 |
| 9,490,580 | B2 * | 11/2016 | Lan | H01R 13/646 |
| 2012/0009818 | A1 * | 1/2012 | Yao | H01R 24/62 439/607.23 |
| 2012/0021646 | A1 * | 1/2012 | Su | H01R 13/506 439/607.01 |
| 2012/0052739 | A1 * | 3/2012 | Wang | H01R 12/724 439/660 |
| 2014/0364006 | A1 * | 12/2014 | Lo | H01R 13/6461 439/607.01 |

* cited by examiner

ELECTRICAL CONNECTOR

BACKGROUND OF THE INVENTION

1. Field of the Invention

The present invention generally relates to an electrical connector, and more particularly to an electrical connector having higher transmission quality, and a conductive terminal fastened to the electrical connector.

2. The Related Art

A conventional electrical connector includes a main body, a main shielding plate, a plurality of conductive terminals and a shielding shell. The main shielding plate is integrally molded in the main body. The conductive terminals are fastened to the main body and arranged in two rows. Each row of the conductive terminals is arranged transversely. The main shielding plate is located between the two rows of the conductive terminals. Each of the conductive terminals has a fastening portion, a contact portion extended frontward from a front end of the fastening portion, and a soldering portion connected with a rear end of the fastening portion.

The fastening portions of the conductive terminals are fastened to the main body and arranged in two rows. Each row of the fastening portions of the conductive terminals are arranged transversely. The main shielding plate is located between the two rows of the fastening portions of the conductive terminals. Contact surfaces of the contact portions of the two rows of the conductive terminals are respectively exposed to a top surface and a bottom surface of the main body. The soldering portions of the conductive terminals project out of the main body and are soldered to a circuit board. The shielding shell surrounds the main body together with the main shielding plate and the conductive terminals. An insertion space is formed between a front end of the shielding shell and a front end of the main body.

However, high-frequency impedances of the conductive terminals of the electrical connector are unable to reach a standard requirement that makes electrical signals transmitted by the electrical connector unstable.

Thus, an innovative electrical connector and conductive terminals of the innovative electrical connector are essential to be provided, high-frequency impedances of the conductive terminals of the innovative electrical connector are improved to be able to reach a standard requirement, so that electrical signals transmitted by the innovative electrical connector are stable for ensuring that the electrical connector has higher transmission quality of the electrical signals.

SUMMARY OF THE INVENTION

An object of the present invention is to provide an electrical connector mounted to a circuit board. The electrical connector includes a main body, a shielding plate assembly and a plurality of conductive terminals. The main body is mounted to the circuit board. The shielding plate assembly is fastened to the main body. The conductive terminals are mounted to the main body and arranged in two rows. The shielding plate assembly is located between the two rows of the conductive terminals. Each row of the conductive terminals is arranged transversely. Each of the conductive terminals has a fastening portion, a contact portion extended frontward from a front end of the fastening portion, and a soldering portion connected with a rear end of the fastening portion. A front end of the contact portion has a contact surface. The fastening portions are fastened in the main body. The shielding plate assembly is located between the two rows of the fastening portions. Thicknesses of two opposite sides of the front end of the contact portion are smaller than a thickness of a middle of the front end of the contact portion. The contact surfaces of the contact portions of the conductive terminals are exposed to a top surface and a bottom surface of the main body, respectively. The soldering portions of the conductive terminals project out of the main body and are soldered to the circuit board.

Another object of the present invention is to provide a conductive terminal fastened to the electrical connector. The electrical connector includes a fastening portion, a contact portion, and a soldering portion connected with a rear end of the fastening portion. The contact portion is extended frontward from a front end of the fastening portion. Thicknesses of two opposite sides of a front end of the contact portion are smaller than a thickness of a middle of the front end of the contact portion. The front end of the contact portion has a contact surface.

As described above, the thicknesses of two opposite sides of the front end of the contact portion are smaller than the thickness of the middle of the front end of the contact portion, so high-frequency impedances of the conductive terminals are improved to be able to reach a standard requirement. As a result, electrical signals transmitted by the electrical connector are stable for ensuring that the electrical connector has higher transmission quality of the electrical signals.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
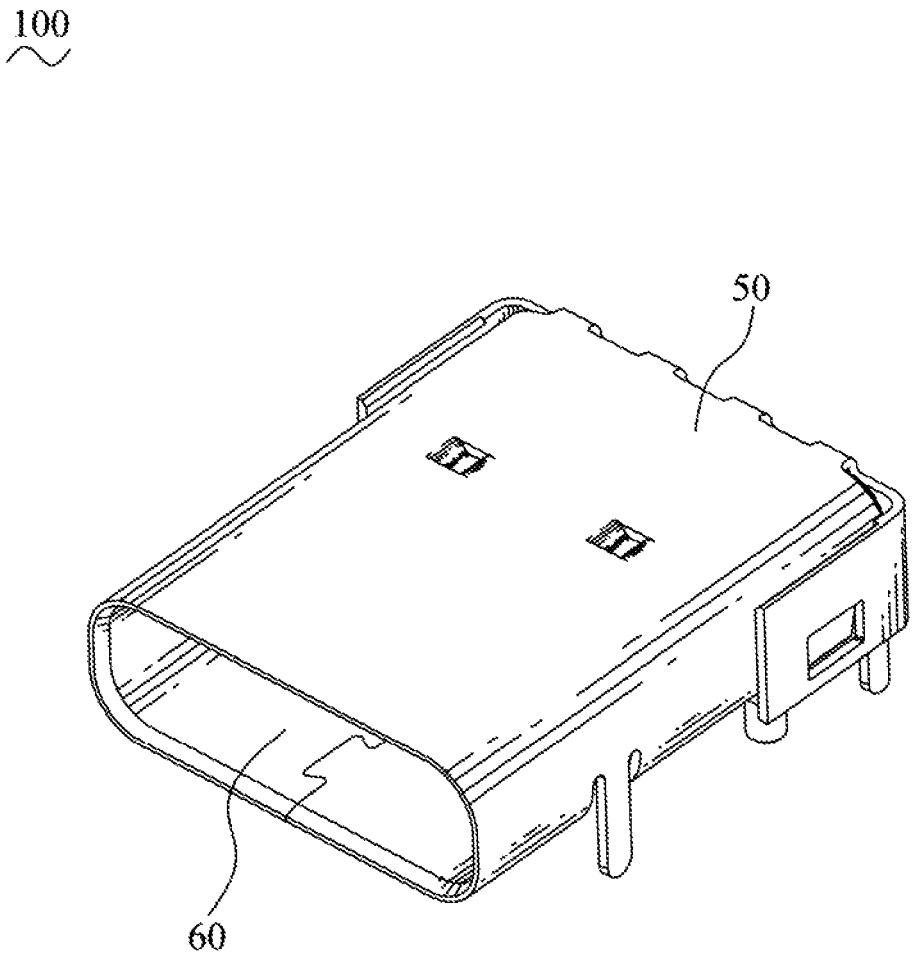
FIG. 1 is a perspective view of an electrical connector in accordance with a first embodiment of the present invention.
Figure 2:
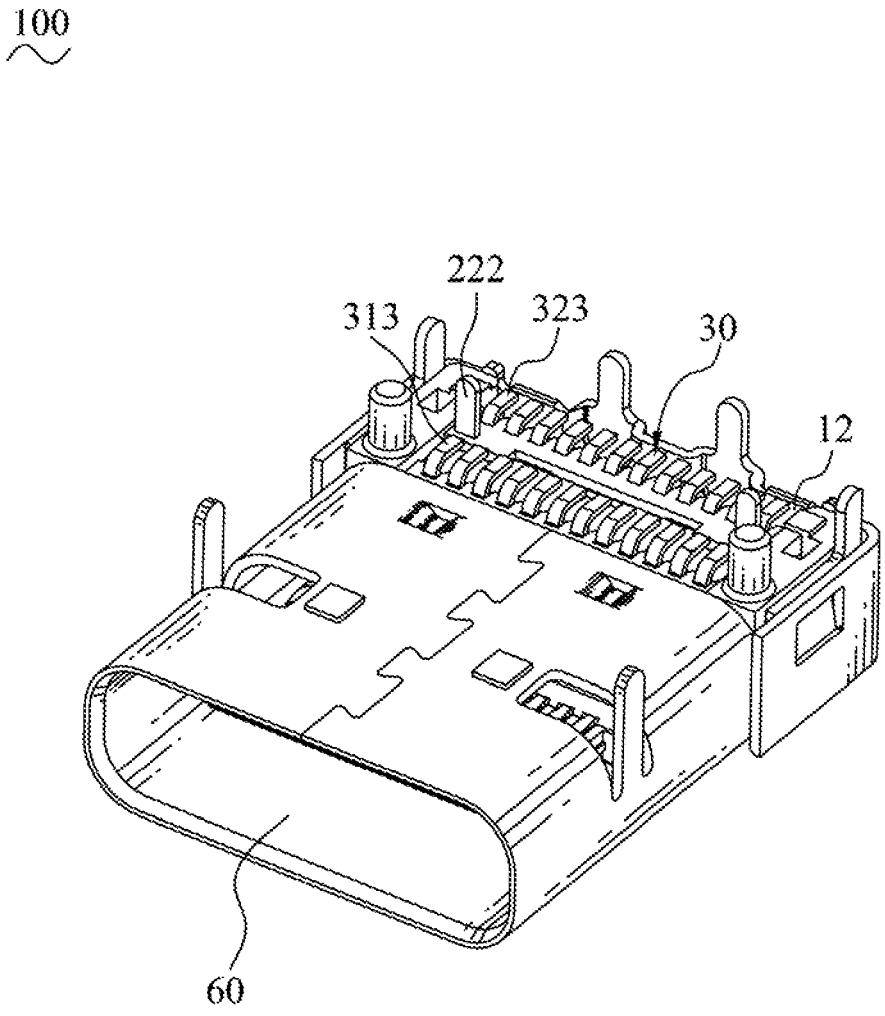
FIG. 2 is another perspective view of the electrical connector of FIG. 1.

With reference to FIGS. 1-2, FIG. 3, FIG. 4, FIG. 5 and FIG. 7, a conductive terminal 30 and an electrical connector 100 in accordance with the present invention are shown. The conductive terminal 30 is fastened to the electrical connector 100. The electrical connector 100 mounted to a circuit board (not shown), includes a main body 10, a shielding plate assembly 20, a plurality of the conductive terminals 30, an inner shielding shell assembly 40 and an outer shielding shell 50.

Figure 3:
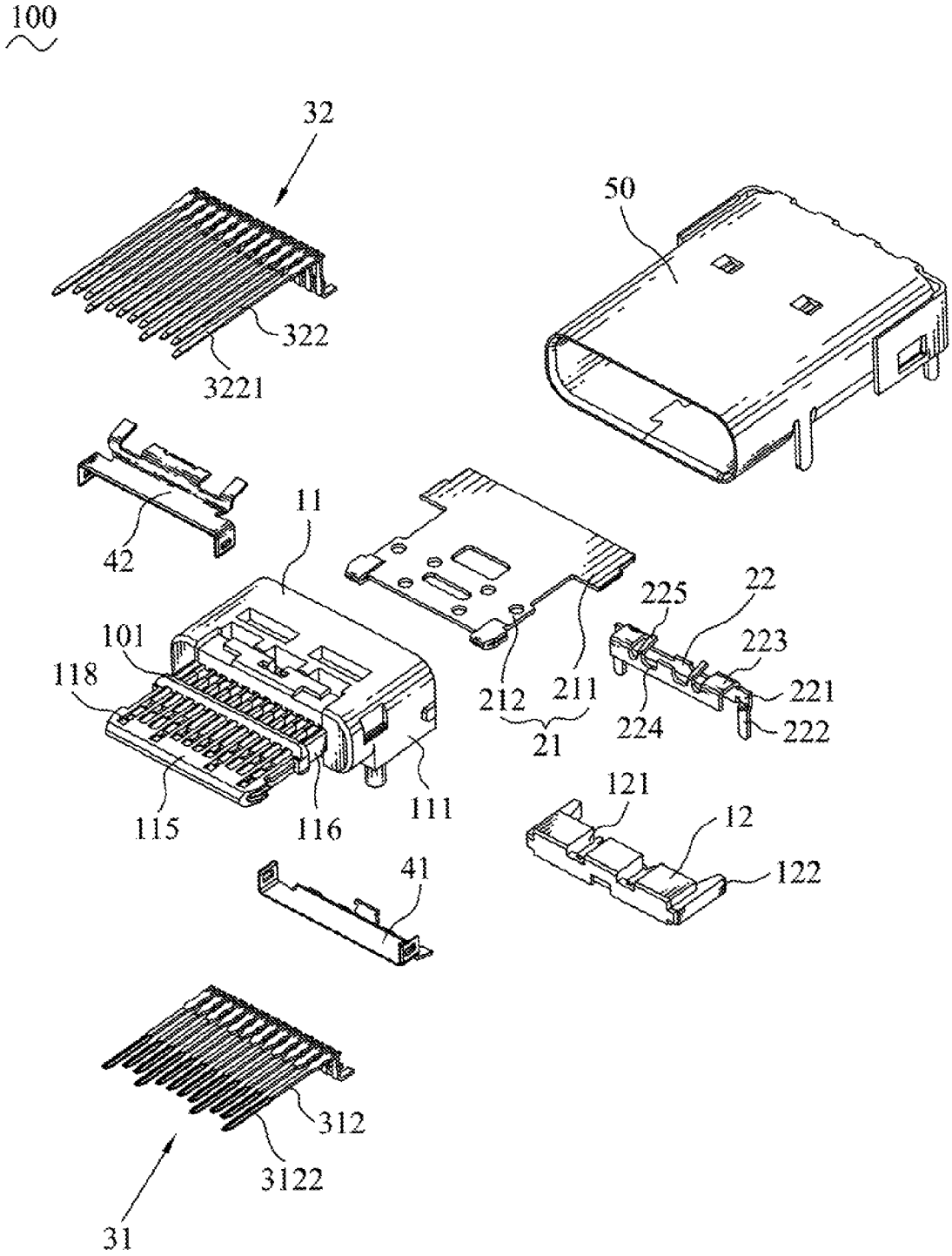
FIG. 3 is an exploded view of the electrical connector of FIG. 1.
Figure 4:
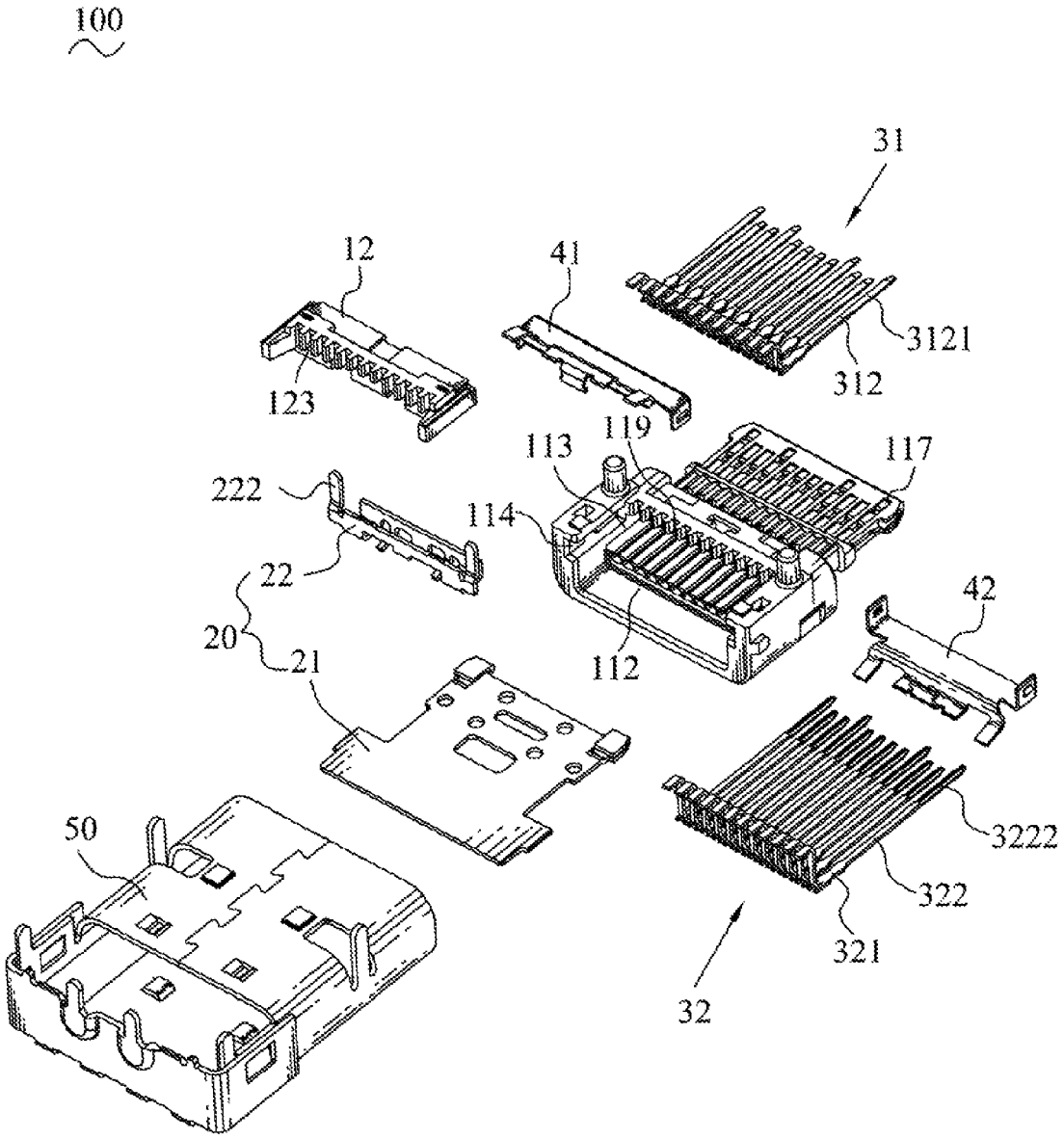
FIG. 4 is another exploded view of the electrical connector of FIG. 1.
Figure 5:
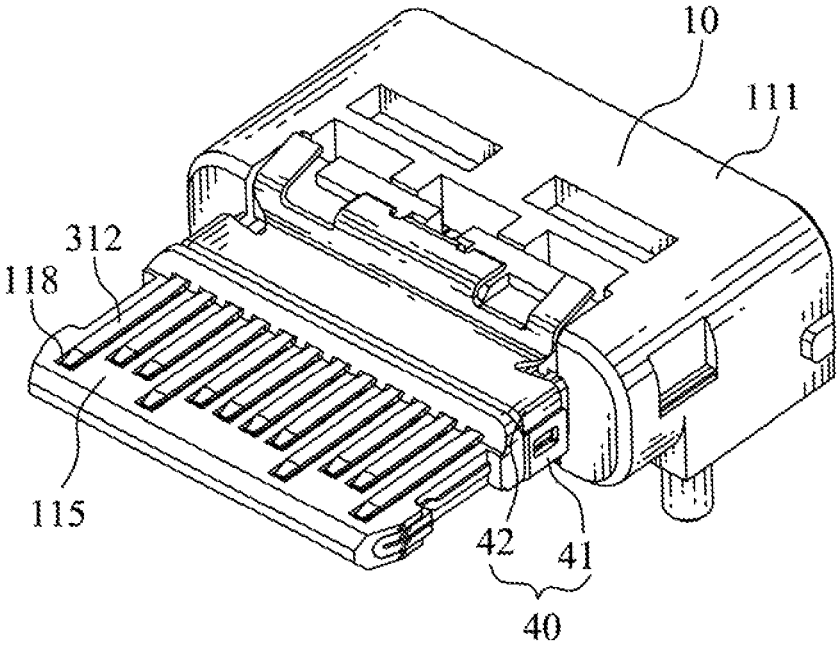
FIG. 5 is a perspective view of the electrical connector of FIG. 1, wherein a shielding shell is removed.
Figure 6:
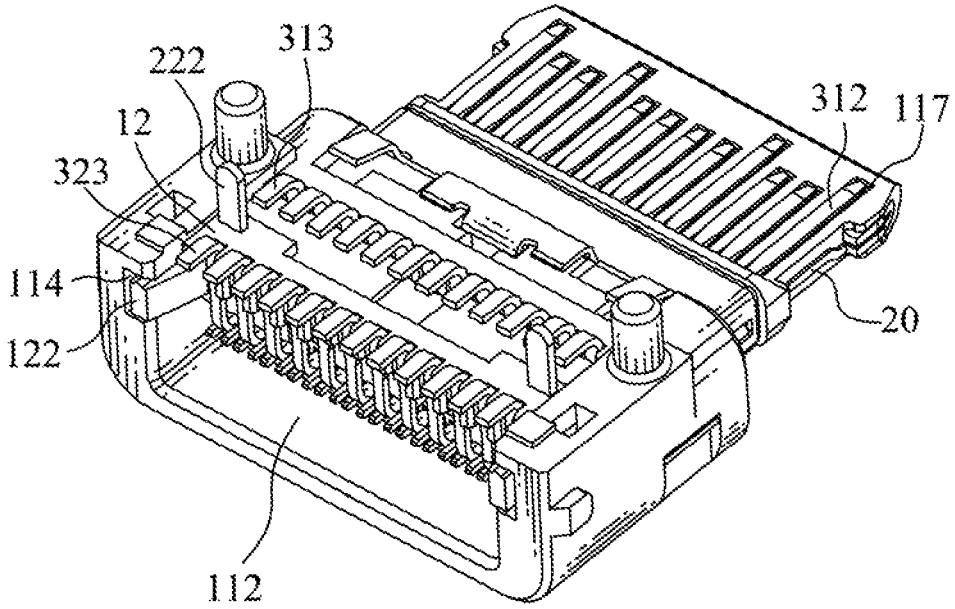
FIG. 6 is another perspective view of the electrical connector of FIG. 5, wherein the shielding shell is removed.

Referring to FIG. 3 to FIG. 5, the main body 10 includes an insulating housing 11 and a fixing block 12. The insulating housing 11 has a base portion 111, and a tongue portion 115 protruded frontward from a middle of a front surface of the base portion 111. The base portion 111 is of a substantial rectangular shape seen from a rear view. The base portion 111 defines an assembling opening 112 penetrating through a rear of a bottom surface and a rear surface of the base portion 111. A front end of a bottom surface of a top wall of the assembling opening 112 protrudes downward to form a supporting block 113 connecting with two inner surfaces of two side walls of the assembling opening 112. The two inner surfaces of the two side walls of the assembling opening 112 are recessed oppositely to form two guiding grooves 114 penetrating through the rear surface of the base portion 111.

A rear of a periphery of the tongue portion 115 is connected with a ring-shaped blocking rib 101. The blocking rib 101 is spaced from the front surface of the base portion 111 to form a receiving groove 116 between the blocking rib 101 and the base portion 111. The base portion 111 defines a plurality of lower terminal grooves 117 penetrating downward through a bottom surface of the tongue portion 115, and penetrating rearward through a lower portion of a front wall of the assembling opening 112 and the rear surface of the base portion 111. The lower terminal grooves 117 are arranged transversely. The base portion 111 defines a plurality of upper terminal grooves 118 penetrating upward through a top surface of the tongue portion 115, and further penetrating rearward through an upper portion of the front wall of the assembling opening 112 and the supporting block 113. The upper terminal grooves 118 extend to the assembling opening 112. The upper terminal grooves 118 are arranged transversely. A rear of the front wall of the assembling opening 112 defines a plurality of spaced first clamping slots 119. The first clamping slots 119 are separately corresponding to the lower terminal grooves 117.

The fixing block 12 is of a rectangular shape seen from a front view. A portion of a top surface of the fixing block 12 is recessed downward to form a receiving opening 121. Middles of two opposite side surfaces of the fixing block 12 protrude outward to form two guiding blocks 122 projecting beyond a rear surface of the fixing block 12. Specifically, two opposite sides of the top surface of the fixing block 12 are recessed downward to form two receiving openings 121 arranged transversely. The fixing block 12 defines a plurality of spaced second clamping slots 123 penetrating through the top surface, a bottom surface and the rear surface of the fixing block 12.

The inner shielding shell assembly 40 includes an upper shell 41, and a lower shell 42 matched with the upper shell 41.

The shielding plate assembly 20 includes a main shielding plate 21 and a ground plate 22. The main shielding plate 21 has a rectangular base plate 211, and an extending plate 212 extended frontward from a middle of a front edge of the base plate 211.

The ground plate 22 has a fastening plate 221 substantially disposed vertically. Two opposite sides of a bottom edge of the fastening plate 221 extend downward to form two insertion feet 222. A top edge of the fastening plate 221 is connected with a resilient portion 225. Specifically, the top edge of the fastening plate 221 is bent frontward and then bent downward to form a holding plate 223. A middle of a top of the holding plate 223 opens a mouth 224. A peripheral wall of the mouth 224 is connected with two resilient portions 225 arranged transversely. The two resilient portions 225 are protruded upward and then slantwise extended upward and rearward from two portions of the peripheral wall of the mouth 224.

Figure 7:
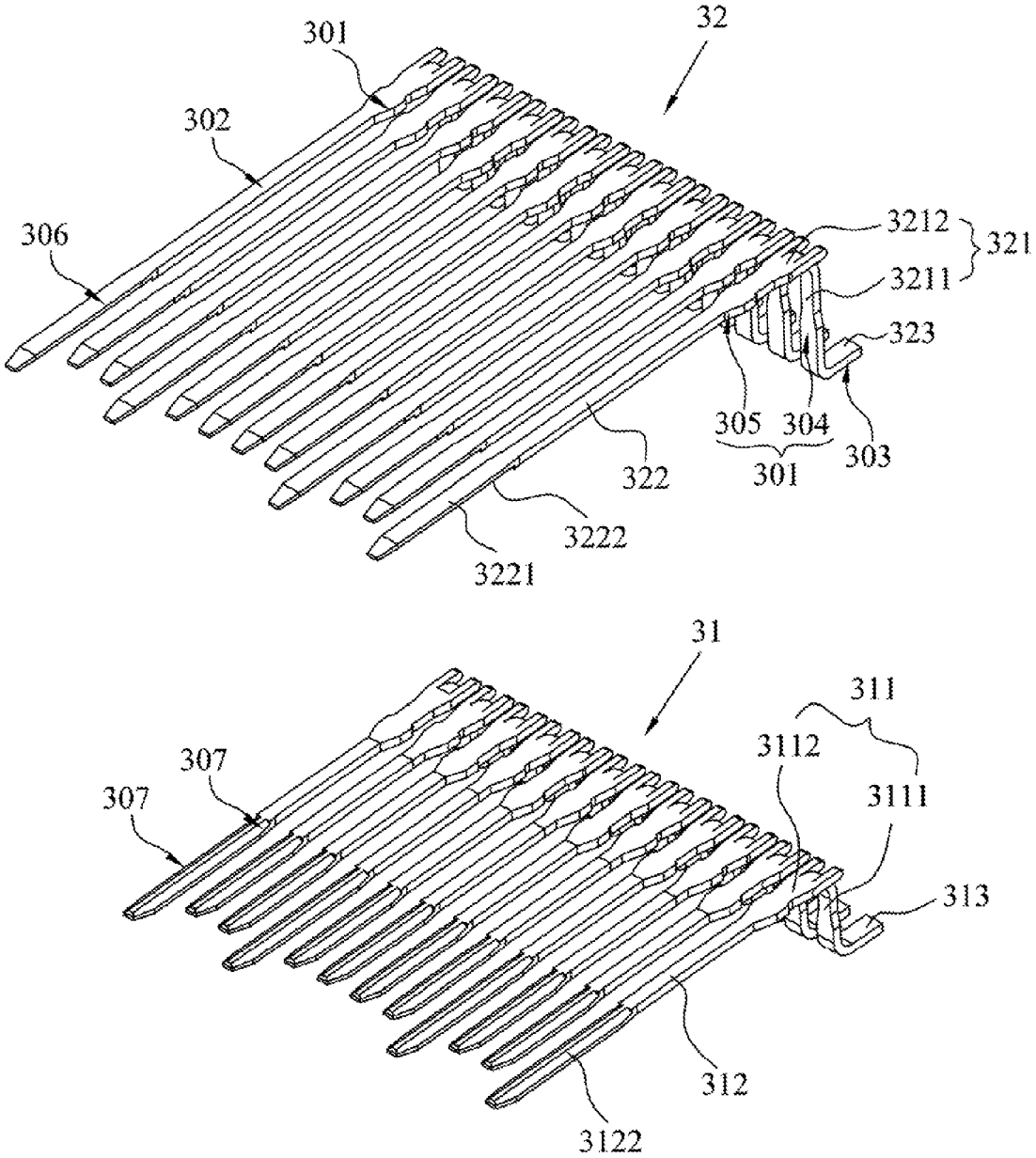
FIG. 7 is a perspective view of conductive terminals of the electrical connector of FIG. 1.
Figure 8:
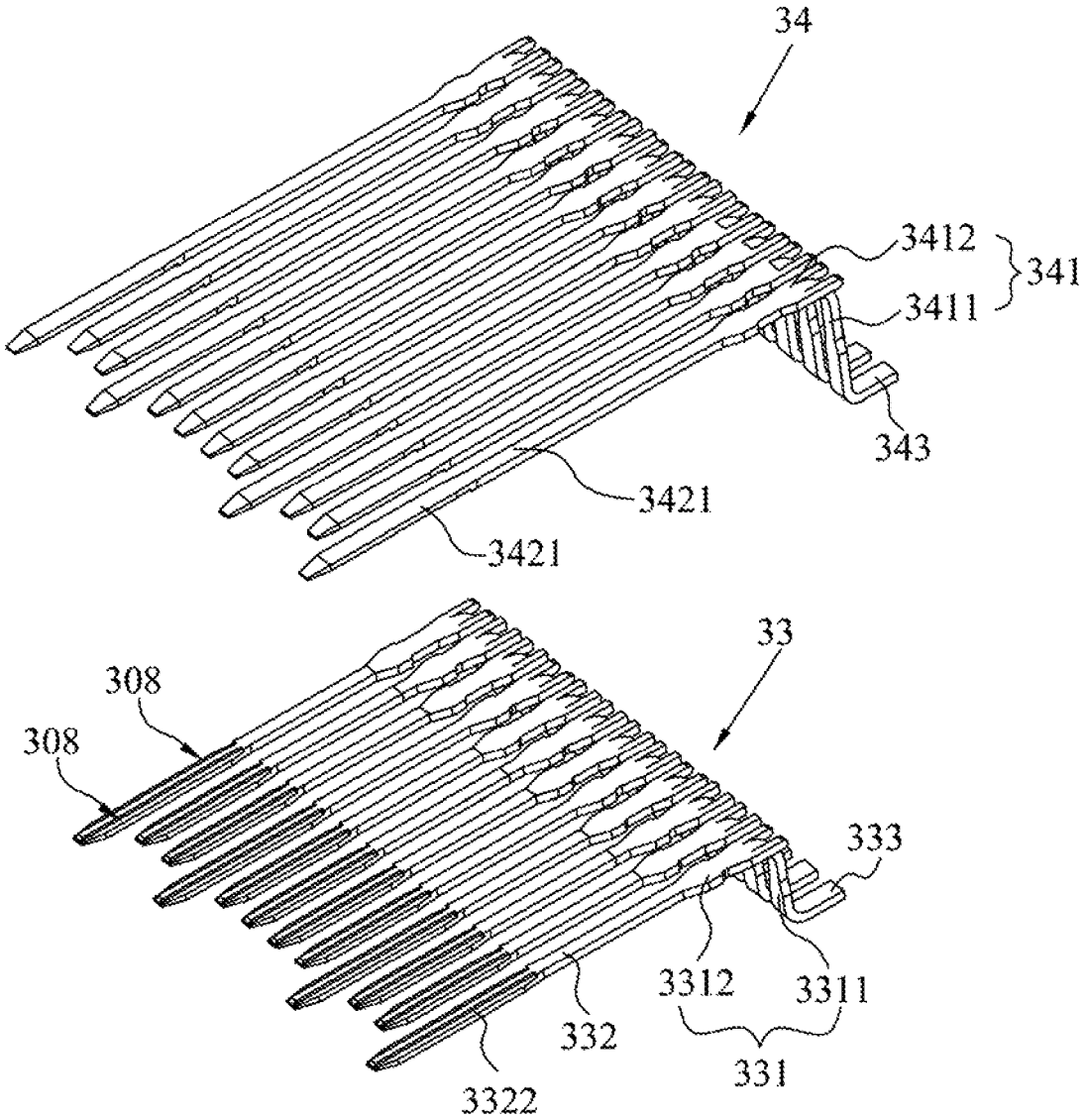
FIG. 8 is a perspective view of the conductive terminals of the electrical connector in accordance with a second embodiment of the present invention.
Figure 9:
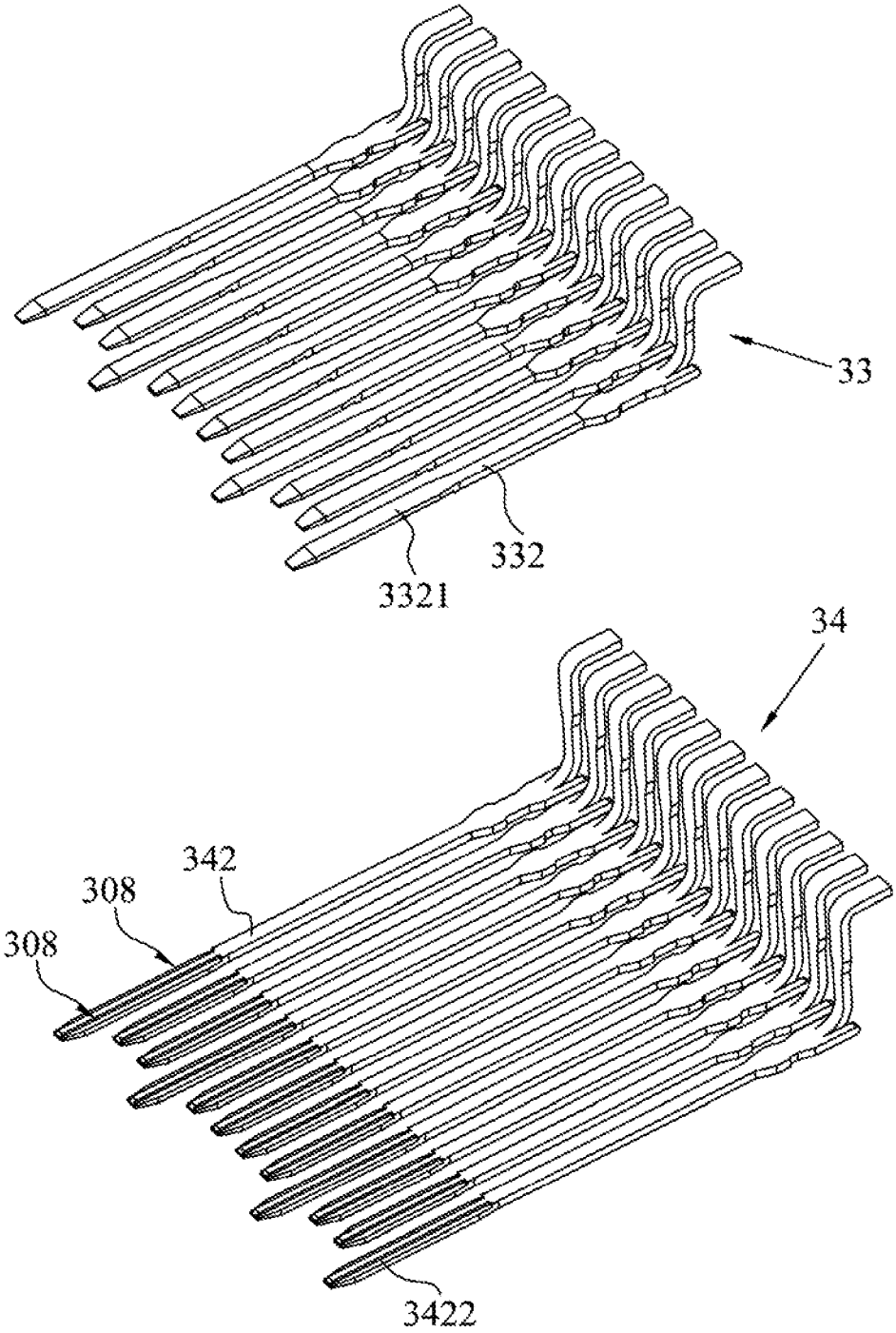
FIG. 9 is another perspective view of the conductive terminals of the electrical connector of FIG. 8.

Referring to FIG. 7 to FIG. 9, each of the conductive terminals 30 has a fastening portion 301, a contact portion 302 extended frontward from a front end of the fastening portion 301, and a soldering portion 303 connected with a rear end of the fastening portion 301. Thicknesses of two opposite sides of a front end of the contact portion 302 are smaller than a thickness of a middle of the front end of the contact portion 302. The front end of the contact portion 302 has a contact surface 306. The fastening portion 301 has a vertical portion 304 extending up and down, and a horizontal portion 305 extended frontward from a top end of the vertical portion 304. The contact portion 302 is extended frontward from a front end of the horizontal portion 305. The soldering portion 303 is extended rearward from a bottom of the vertical portion 304.

Referring to FIG. 3 to FIG. 7, the electrical connector 100 in accordance with a first embodiment of the present invention is shown. A junction between one side surface of the contact portion 302 and a surface of the front end of the contact portion 302 opposite to the contact surface 306 and a junction between the other side surface of the contact portion 302 and the surface of the front end of the contact portion 302 opposite to the contact surface 306 define two inclined surfaces 307. Specifically, the conductive terminals 30 include a plurality of first terminals 31 and a plurality of second terminals 32. Each of the first terminals 31 has a first fastening portion 311, a first contact portion 312 extended frontward from a front end of the first fastening portion 311, and a first soldering portion 313 connected with a rear end of the first fastening portion 311. The first fastening portion 311 has a first vertical portion 3111 extending up and down, and a first horizontal portion 3112 extended frontward from a top end of the first vertical portion 3111.

The first contact portion 312 is extended frontward from a front end of the first horizontal portion 3112. The first soldering portion 313 is extended rearward from a bottom of the first vertical portion 3111. A bottom surface of a front end of the first contact portion 312 is defined as a first contact surface 3121. A junction between one side surface of the first contact portion 312 and a surface of the front end of the first contact portion 312 opposite to first contact surface 3121 and a junction between the other side surface of the first contact portion 312 and the surface of the front end of the first contact portion 312 opposite to the first contact surface 3121 define two first inclined surfaces 3122.

Each of the second terminals 32 has a second fastening portion 321, a second contact portion 322 extended frontward from a front end of the second fastening portion 321, and a second soldering portion 323 connected with a rear end of the second fastening portion 321. The second fastening portion 321 has a second vertical portion 3211 extending up and down, and a second horizontal portion 3212 extended frontward from a top end of the second vertical portion 3211. The second contact portion 322 is extended frontward from a front end of the second horizontal portion 3212. A front end of a top surface of the second contact portion 322 is defined as a second contact surface 3221. A junction between one side surface of the second contact portion 322 and a surface of the second contact portion 322 opposite to the second contact surface 3221 and a junction between the other side surface of the second contact portion 322 and the surface of the second contact portion 322 opposite to the second contact surface 3221 define two second inclined surfaces 3222. The second soldering portion 323 is extended rearward from a bottom of the second vertical portion 3211.

Referring to FIG. 1, FIG. 8 and FIG. 9, the electrical connector 100 in accordance with a second embodiment of the present invention is shown. A difference between the electrical connector 100 in accordance with the first embodiment and the second embodiment is described as follows. In the second embodiment, the two opposite sides of the surface of the front end of the contact portion 302 opposite to the contact surface 306 define two lacking grooves 308.

Specifically, the conductive terminals 30 include a plurality of third terminals 33 and a plurality of fourth terminals 34. Each of the third terminals 33 has a third fastening portion 331, a third contact portion 332 extended frontward from a front end of the third fastening portion 331, and a third soldering portion 333 connected with a rear end of the third fastening portion 331. The third fastening portion 331 has a third vertical portion 3311 extending up and down, and a third horizontal portion 3312 extended frontward from a top end of the third vertical portion 3311. The third contact portion 332 is extended frontward from a front end of the third horizontal portion 3312. A front end of a bottom surface of the third contact portion 332 is defined as a third contact surface 3321. Two opposite sides of a top surface of the front end of the third contact portion 332 define two first lacking grooves 3322. The third soldering portion 333 is extended rearward from a bottom of the third vertical portion 3311.

Each of the fourth terminals 34 has a fourth fastening portion 341, a fourth contact portion 342 extended frontward from a front end of the fourth fastening portion 341, and a fourth soldering portion 343 connected with a rear end of the fourth fastening portion 341. The fourth fastening portion 341 has a fourth vertical portion 3411 extending up and down, and a fourth horizontal portion 3412 extended frontward from a top end of the fourth vertical portion 3411. The fourth contact portion 342 is extended frontward from a front end of the fourth horizontal portion 3412. A front end of a bottom surface of the fourth contact portion 342 is defined as a fourth contact surface 3421. Two opposite sides of the front end of a top surface of the fourth contact portion 342 define two second lacking grooves 3422. The fourth soldering portion 343 is extended rearward from a bottom of the fourth vertical portion 3411.

Referring to FIG. 1, FIG. 8 and FIG. 9, the shielding plate assembly 20 is fastened to the main body 10. Specifically, the shielding plate assembly 20 is integrally molded in the main body 10 and located between the lower terminal grooves 117 and the upper terminal grooves 118. A top surface of a rear of the main shielding plate 21 abuts against a bottom surface of the supporting block 113. Specifically, the base plate 211 and a rear end of the extending plate 212 of the main shielding plate 21 are integrally molded in the base portion 111. A top surface of the base plate 211 abuts against the bottom surface of the supporting block 113. A rear surface of the base plate 211 is flush with a rear surface of the supporting block 113. A front end of the extending plate 212 is integrally molded in the tongue portion 115.

The conductive terminals 30 are mounted to the main body 10 and arranged in two rows. The shielding plate assembly 20 is located between the two rows of the conductive terminals 30. Each row of the conductive terminals 30 are arranged transversely. The fastening portions 301 of the conductive terminals 30 are fastened in the main body 10. The contact surfaces 306 of the contact portions 302 of the conductive terminals 30 are exposed to a top surface and a bottom surface of the main body 10, respectively. The soldering portions 303 of the conductive terminals 30 project out of the main body 10 and are soldered to the circuit board.

In the first embodiment, the first horizontal portions 3112 of the first terminals 31 are separately fastened in rear ends of the lower terminal grooves 117. The first contact portions 312 of the first terminals 31 are separately fastened in front ends of the lower terminal grooves 117. The first contact surfaces 3121 of the first terminals 31 are exposed to a front end of the bottom surface of the tongue portion 115. The first vertical portions 3111 of the first terminals 31 are received in a front of the assembling opening 112. The first vertical portions 3111 of the first terminals 31 are separately fastened in the first clamping slots 119. Bottom surfaces of the first soldering portions 313 of the first terminals 31 project beyond the bottom surface of the base portion 111.

In the second embodiment, the third horizontal portions 3312 of the third terminals 33 are separately fastened in the rear ends of the lower terminal grooves 117. The third contact portions 332 of the third terminals 33 are separately fastened in the front ends of the lower terminal grooves 117. The third contact surfaces 3321 of the third terminals 33 are exposed to the front end of the bottom surface of the tongue portion 115. The third vertical portions 3311 of the third terminals 33 are received in the front of the assembling opening 112. The third vertical portions 3311 of the third terminals 33 are separately fastened in the first clamping slots 119. Bottom surfaces of the third soldering portions 333 of the third terminals 33 project beyond the bottom surface of the base portion 111.

The fastening plate 221 and the holding plate 223 of the ground plate 22 are integrally molded in the fixing block 12. The insertion feet 222 project beyond the bottom surface of the fixing block 12. The resilient portion 225 projects beyond the top surface of the fixing block 12. The fixing block 12 is assembled in the assembling opening 112 under the guidance of the two guiding grooves 114 and the two guiding blocks 122. The fixing block 12 is located above the main shielding plate 21 and located between the first vertical portions 3111 of the first terminals 31 and the second vertical portions 3211 of the second terminals 32. The resilient portion 225 abuts against the base plate 211 of the main shielding plate 21.

In the first embodiment, the second horizontal portions 3212 of the second terminals 32 are separately fastened in rear ends of the upper terminal grooves 118. The second contact portions 322 of the second terminals 32 are separately fastened in front ends of the upper terminal grooves 118. The second contact surfaces 3221 of the second terminals 32 are exposed to a front end of the top surface of the tongue portion 115. The second vertical portions 3211 of the second terminals 32 are received in a rear of the assembling opening 112. The second vertical portions 3211 of the second terminals 32 are separately clamped in the second clamping slots 123. Bottom surfaces of the second soldering portions 323 of the second terminals 32 project beyond the bottom surface of the fixing block 12.

In the second embodiment, the fourth horizontal portions 3412 of the fourth terminals 34 are separately fastened in the rear ends of the upper terminal grooves 118. The fourth contact portions 342 of the fourth terminals 34 are separately fastened in the front ends of the upper terminal grooves 118. The fourth contact surfaces 3421 of the fourth terminals 34 are exposed to the front end of the top surface of the tongue portion 115. The fourth vertical portions 3411 of the fourth terminals 34 are received in the rear of the assembling opening 112. The fourth vertical portions 3411 of the fourth terminals 34 are separately clamped in the second clamping slots 123. Bottom surfaces of the fourth soldering portions 343 of the fourth terminals 34 project beyond the bottom surface of the fixing block 12.

The inner shielding shell assembly 40 surrounds a rear end of the tongue portion 115. The upper shell 41 is received in an upper portion of the receiving groove 116. The lower shell 42 is received in a lower portion of the receiving groove 116 and fastened to the upper shell 41.

The outer shielding shell 50 surrounds the main body 10 together with the shielding plate assembly 20, the conductive terminals 30 and the inner shielding shell assembly 40. An insertion space 60 is formed between a front end of the outer shielding shell 50 and a front end of the main body 10. Specifically, the insertion space 60 is formed between the front end of the outer shielding shell 50 and the tongue portion 115.

The main body 10 is mounted to the circuit board. The conductive terminals 30 are fastened to the circuit board. The soldering portions 303 of the conductive terminals 30 are soldered to the circuit board. The insertion feet 222 are fastened to the circuit board.

As described above, the thicknesses of the two opposite sides of the front end of the contact portion 302 are smaller than the thickness of the middle of the front end of the contact portion 302, so high-frequency impedances of the conductive terminals 30 are improved to be able to reach a standard requirement. As a result, electrical signals transmitted by the electrical connector 100 are stable for ensuring that the electrical connector 100 has higher transmission quality of the electrical signals.

What is claimed is:

1. An electrical connector mounted to a circuit board, comprising:

a main body mounted to the circuit board;

a shielding plate assembly fastened to the main body; and a plurality of conductive terminals mounted to the main body and arranged in two rows, the shielding plate assembly being located between the two rows of the conductive terminals, each row of the conductive terminals being arranged transversely, each of the conductive terminals having a fastening portion, a contact portion extended frontward from a front end of the fastening portion, and a soldering portion connected with a rear end of the fastening portion, a front end of the contact portion having a contact surface, the fastening portions being fastened in the main body, the shielding plate assembly being located between the two rows of the fastening portions, thicknesses of two opposite sides of the front end of the contact portion being smaller than a thickness of a middle of the front end of the contact portion, the contact surfaces of the contact portions of the conductive terminals being exposed to a top surface and a bottom surface of the main body, respectively, the soldering portions of the conductive terminals projecting out of the main body and being soldered to the circuit board;

wherein two opposite sides of a surface of the front end of the contact portion opposite to the contact surface define two lacking grooves.

2. The electrical connector as claimed in claim 1, wherein a junction between one side surface of the contact portion and a surface of the front end of the contact portion opposite to the contact surface and a junction between the other side surface of the contact portion and the surface of the front end of the contact portion opposite to the contact surface define two inclined surfaces.

3. The electrical connector as claimed in claim 1, wherein the fastening portion has a vertical portion extending up and down, and a horizontal portion extended frontward from a top end of the vertical portion, the contact portion is extended frontward from a front end of the horizontal portion, the soldering portion is extended rearward from a bottom of the vertical portion.

4. The electrical connector as claimed in claim 1, wherein the main body includes an insulating housing which has a base portion, and a tongue portion protruded frontward from a middle of a front surface of the base portion, the base portion defines a plurality of lower terminal grooves penetrating downward through a bottom surface of the tongue portion, and penetrating rearward through a rear surface of the base portion, the conductive terminals include a plurality of first terminals, each of the first terminals has a first fastening portion which has a first vertical portion extending up and down, and a first horizontal portion extended frontward from a top end of the first vertical portion, a first contact portion extended frontward from a front end of the first horizontal portion, and a first soldering portion extended rearward from a bottom of the first vertical portion, the first horizontal portions of the first terminals are separately fastened in rear ends of the lower terminal grooves, the first contact portions of the first terminals are separately fastened in front ends of the lower terminal grooves.

5. The electrical connector as claimed in claim 4, wherein a bottom surface of a front end of the first contact portion is defined as a first contact surface, the first contact surfaces of the first terminals are exposed to a front end of the bottom surface of the tongue portion.

6. The electrical connector as claimed in claim 4, wherein the base portion defines an assembling opening penetrating through a rear of a bottom surface and the rear surface of the base portion, a rear of a front wall of the assembling opening defines a plurality of first clamping slots separately corresponding to the lower terminal grooves, the first vertical portions of the first terminals are received in a front of the assembling opening, the first vertical portions of the first terminals are separately fastened in the first clamping slots, bottom surfaces of the first soldering portions of the first terminals project beyond the bottom surface of the base portion.

7. The electrical connector as claimed in claim 6, wherein the conductive terminals include a plurality of second terminals, each of the second terminals has a second fastening portion which has a second vertical portion extending up and down, and a second horizontal portion extended frontward from a top end of the second vertical portion, a second contact portion extended frontward from a front end of the second horizontal portion, a second soldering portion extended rearward from a bottom of the second vertical portion, the base portion defines a plurality of upper terminal grooves penetrating upward through a top surface of the tongue portion and extending to the assembling opening, the second horizontal portions of the second terminals are separately fastened in rear ends of the upper terminal grooves, the second contact portions of the second terminals are separately fastened in front ends of the upper terminal grooves, the second vertical portions of the second terminals are received in a rear of the assembling opening.

8. The electrical connector as claimed in claim 7, wherein a front end of a top surface of the second contact portion is defined as a second contact surface, the second contact surfaces of the second terminals are exposed to a front end of the top surface of the tongue portion.

9. The electrical connector as claimed in claim 7, wherein the main body includes a fixing block which defines a plurality of spaced second clamping slots penetrating through a top surface, a bottom surface and a rear surface of the fixing block, the fixing block is assembled in the assembling opening and located between the first vertical portions of the first terminals and the second vertical portions of the second terminals, the second vertical portions of the second terminals are separately clamped in the second clamping slots, bottom surfaces of the second soldering portions of the second terminals project beyond the bottom surface of the fixing block.

10. The electrical connector as claimed in claim 9, wherein the shielding plate assembly includes a main shielding plate and a ground plate, a front end of a bottom surface of a top wall of the assembling opening protrudes downward to form a supporting block, the shielding plate assembly is integrally molded in the main body and located between the lower terminal grooves and the upper terminal grooves, a top surface of a rear of the main shielding plate abuts against a bottom surface of the supporting block.

11. The electrical connector as claimed in claim 10, wherein the ground plate has a fastening plate substantially disposed vertically, two opposite sides of a bottom edge of the fastening plate extend downward to form two insertion feet, a top edge of the fastening plate is connected with a resilient portion, the fastening plate is integrally molded in the fixing block, the insertion feet project beyond the bottom surface of the fixing block and fastened to the circuit board, the resilient portion projects beyond the top surface of the fixing block and abuts against the main shielding plate.

12. The electrical connector as claimed in claim 1, further comprising an outer shielding shell surrounding the main body together with the shielding plate assembly and the conductive terminals, an insertion space being formed between a front end of the outer shielding shell and a front end of the main body.

13. A conductive terminal fastened to an electrical connector, comprising:

a fastening portion;

a contact portion extended frontward from a front end of the fastening portion, thicknesses of two opposite sides of a front end of the contact portion being smaller than a thickness of a middle of the front end of the contact portion, the front end of the contact portion having a contact surface; and a soldering portion connected with a rear end of the fastening portion;

wherein two opposite sides of a surface of the front end of the contact portion opposite to the contact surface define two lacking grooves.

14. The conductive terminal as claimed in claim 13, wherein the fastening portion has a vertical portion extending up and down, and a horizontal portion extended frontward from a top end of the vertical portion, the contact portion is extended frontward from a front end of the horizontal portion, the soldering portion is extended rearward from a bottom of the vertical portion.

15. The conductive terminal as claimed in claim 13, wherein a junction between one side surface of the contact portion and a surface of the front end of the contact portion opposite to the contact surface and a junction between the other side surface of the contact portion and the surface of the front end of the contact portion opposite to the contact surface define two inclined surfaces.

16. An electrical connector mounted to a circuit board, comprising:

a main body mounted to the circuit board;

a shielding plate assembly fastened to the main body; and a plurality of conductive terminals mounted to the main body and arranged in two rows, the shielding plate assembly being located between the two rows of the conductive terminals, each row of the conductive terminals being arranged transversely, each of the conductive terminals having a fastening portion, a contact portion extended frontward from a front end of the fastening portion, and a soldering portion connected with a rear end of the fastening portion, a front end of the contact portion having a contact surface, the fastening portions being fastened in the main body, the shielding plate assembly being located between the two rows of the fastening portions, thicknesses of two opposite sides of the front end of the contact portion being smaller than a thickness of a middle of the front end of the contact portion, the contact surfaces of the contact portions of the conductive terminals being exposed to a top surface and a bottom surface of the main body, respectively, the soldering portions of the conductive terminals projecting out of the main body and being soldered to the circuit board;

wherein a junction between one side surface of the contact portion and a surface of the front end of the contact portion opposite to the contact surface and a junction between the other side surface of the contact portion and the surface of the front end of the contact portion opposite to the contact surface define two inclined surfaces.

17. A conductive terminal fastened to an electrical connector, comprising:

a fastening portion;

a contact portion extended frontward from a front end of the fastening portion, thicknesses of two opposite sides of a front end of the contact portion being smaller than a thickness of a middle of the front end of the contact portion, the front end of the contact portion having a contact surface; and a soldering portion connected with a rear end of the fastening portion;

wherein a junction between one side surface of the contact portion and a surface of the front end of the contact portion opposite to the contact surface and a junction between the other side surface of the contact portion and the surface of the front end of the contact portion opposite to the contact surface define two inclined surfaces.

* * * * *